US005649494A

United States Patent [19]

Hufton

[11] Patent Number: 5,649,494

[45] Date of Patent: Jul. 22, 1997

[54] BURNER FOR THE COMBUSTION OF FUEL

[75] Inventor: Peter F. Hufton, Etwall, England

[73] Assignee: Rolls-Royce Power Engineering plc, Newcastle Upon Tyne, England

[21] Appl. No.: 386,873

[22] Filed: Feb. 10, 1995

[30] Foreign Application Priority Data

Feb. 10, 1994 [GB] United Kingdom ..... 9402553

[51] Int. Cl.[6] ..... F23D 1/00

[52] U.S. Cl. ..... 110/262; 110/104 B; 110/264; 110/265; 110/347; 431/184

[58] Field of Search ..... 110/260–262, 264, 110/104 B, 347; 431/168, 172, 182–185, 187

[56] References Cited

U.S. PATENT DOCUMENTS

| | | | |
|---|---|---|---|
| 4,357,134 | 11/1982 | Katsuhige et al. . | |
| 4,443,182 | 4/1984 | Wojcieson et al. | 431/187 X |
| 4,602,571 | 7/1986 | Chadshay | 110/264 |
| 4,930,430 | 6/1990 | Allen et al. | 431/185 X |
| 5,199,355 | 4/1993 | Larue | 431/187 X |
| 5,231,937 | 8/1993 | Kobayashi et al. | 110/262 |
| 5,415,114 | 5/1995 | Monro et al. | 431/184 X |

FOREIGN PATENT DOCUMENTS

| | | |
|---|---|---|
| 0 091 988 | 10/1983 | European Pat. Off. . |
| 0 124 146 | 7/1984 | European Pat. Off. . |
| 0 343 767 | 11/1989 | European Pat. Off. . |
| 2 080 513 | 2/1982 | United Kingdom . |

*Primary Examiner*—Henry A. Bennett
*Assistant Examiner*—Susanne C. Tinker
*Attorney, Agent, or Firm*—Oliff & Berridge

[57] ABSTRACT

A burner (10) for the combustion of fuel comprises a passage (32) through which in operation a mixed flow of fuel and air passes for primary combustion at it's outlet. Two further annular passages (34, 36), concentric with and radially outward of the passage (32), are provided through which supplementary flows of air pass to support the primary combustion. The outlets of the two annular passages (34, 36) diverge to discharge the supplementary flows of air at an angle to the mixed flow of fuel and air. Members (62) are provided in the annular passage which obstruct the discharge of the supplementary flow of air. Furnace gases circulate in the region downstream of the obstruction members (62). Circulation of the furnace gases delays the mixing of the fuel and air mixture with the supplementary air flows to reduce the nitrogen oxides produced.

9 Claims, 3 Drawing Sheets

BURNER FOR THE COMBUSTION OF FUEL

The present invention relates to burners and in particular to burners which yield low levels of nitrogen oxide in their combustion products.

The emission of pollutants in combustion products are legislatively controlled due to environmental concerns. Burners are therefore designed to reduce the amount of pollutants, especially nitrogen oxides, that they produce in operation. The amount of nitrogen oxide emitted in combustion products depends upon the flame temperature, the amount of oxygen available during combustion and the nitrogen content of the fuel.

An example of a burner designed to reduce nitrogen oxide emissions can be found in European patent number 0343767, which is owned by the applicant. In EP0343767 a burner is described which uses primary, secondary and tertiary combustion air flows. Deflecting elements are arranged in the primary combustion air/fuel flow to produce regions of high fuel concentration. Flow disturbing members which assist in stabilising of the flame at the burner outlet are used in combination with these deflecting elements to promote conditions that reduce the nitrogen oxide emissions.

As the legislation controlling the amount of pollutants emitted in combustion products becomes more stringent it is necessary to further reduce the nitrogen oxide emissions.

The present invention seeks to provide an improved burner for combustion of fuel in a combustion chamber which further reduces the nitrogen oxide emissions present in the combustion products.

According to the present invention a burner for the combustion of fuel which in operation is mounted in a furnace and has a discharge plane adjacent the furnace wall comprises at least one passage through which in operation a mixed flow of fuel and air passes for primary combustion at an outlet from said passage and at least one further annular passage, concentric with and radially outward of the first passage, through which a supplementary flow of air passes for discharge at an outlet for combustion with the products of said primary combustion, the at least one further annular passage diverging at its outlet to discharge the supplementary flow of air at an angle to the mixed flow of fuel and air, the outlet from the at least one further passage being provided with a plurality of members which pass across the outlet at the discharge plane of the burner to obstruct a proportion of the supplementary flow of air discharged therefrom, adjacent obstruction members defining a plurality of discrete apertures in the outlet of the at least one further passage through which the supplementary flow of air discharges, the diverging outlet producing pressure gradients downstream of the obstruction members which causes furnace gases radially outward of the at least one further passage to flow radially inward and interpose between the mixed flow of air and fuel from the first passage and the supplementary air flow from the further passage, the gases delaying mixing of the flows and reducing the oxygen content of the supplementary air thereby reducing the nitrogen oxides produced.

Preferably the obstructing members are wedge shaped.

The inlet to the at least one further passage may be convergent and may have guide vanes located therein. The amount of air passing through the inlet to the at least one further passage may be controlled by an annular baffle plate.

In the preferred embodiment of the present invention there are two further annular passages, a radially inner and a radially outer annular passage, both of which are concentric with the at least one first passage and which provide supplementary air flows for combustion with the products of said primary combustion.

Vanes may be provided in the radially inner annular passage which swirl the supplementary flow of air passing therethrough. The vanes can be moved in an axial direction to vary the degree of swirl in the supplementary air passing therethrough.

Preferably the at least one first passage is provided with elements which produce fuel rich areas in the air and fuel mixture passing therethrough. Flow disturbing means are also provided at the outlet of the at least one first passage which modify the flow pattern of the air and fuel mixture at the outlet of the at least one first passage. The flow disturbing members are located in the wake of the air flow from the elements.

In a preferred embodiment of the present invention, in which coal is burnt, the wedge shaped plates obstruct of the order of 15% of the supplementary flow of air.

The present invention will now be described with reference to the accompanying drawings in which.

Figure 1:
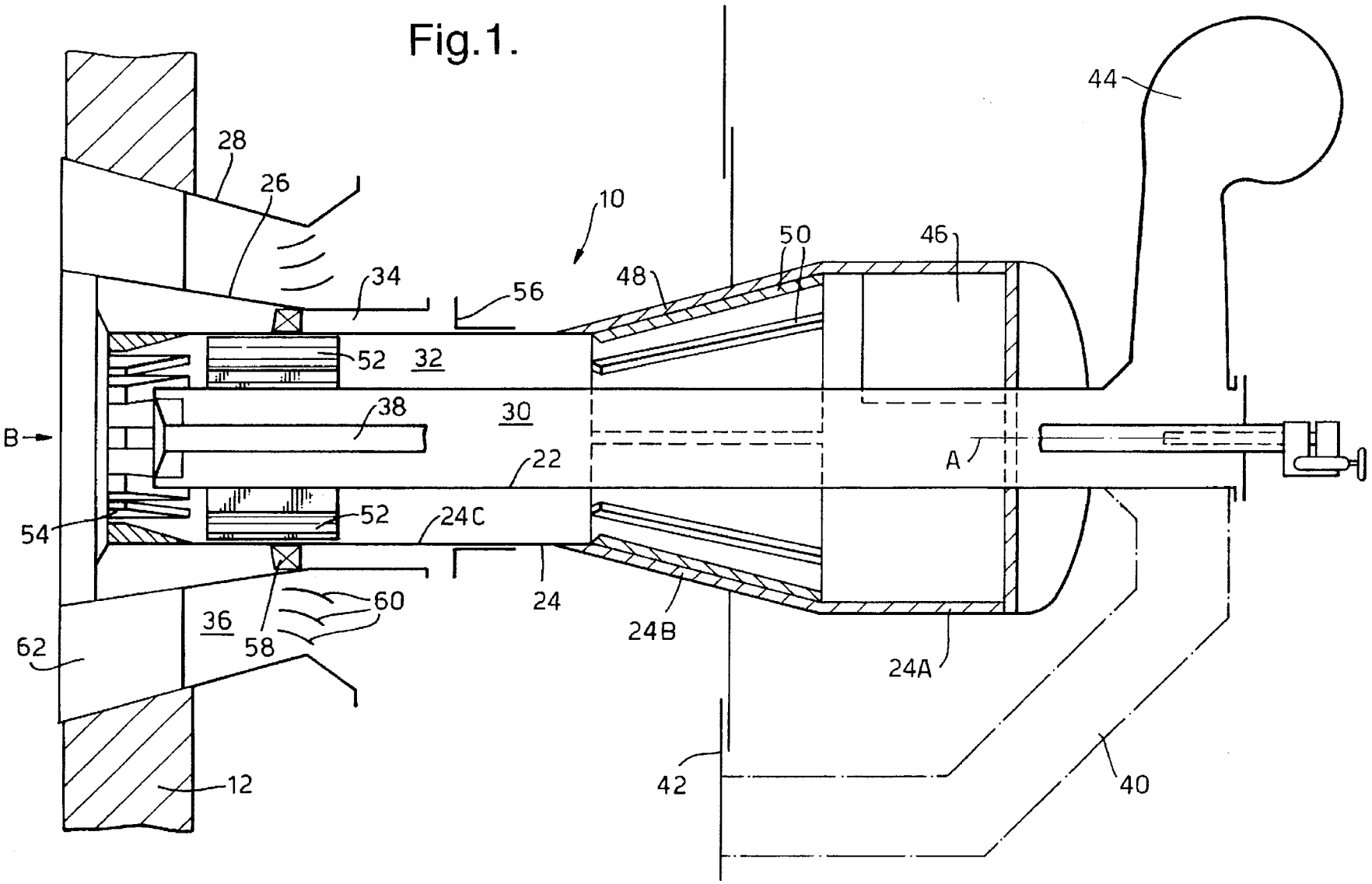
FIG. 1 is a schematic longitudinal cross section through a burner constructed in accordance with the present invention.
Figure 2:
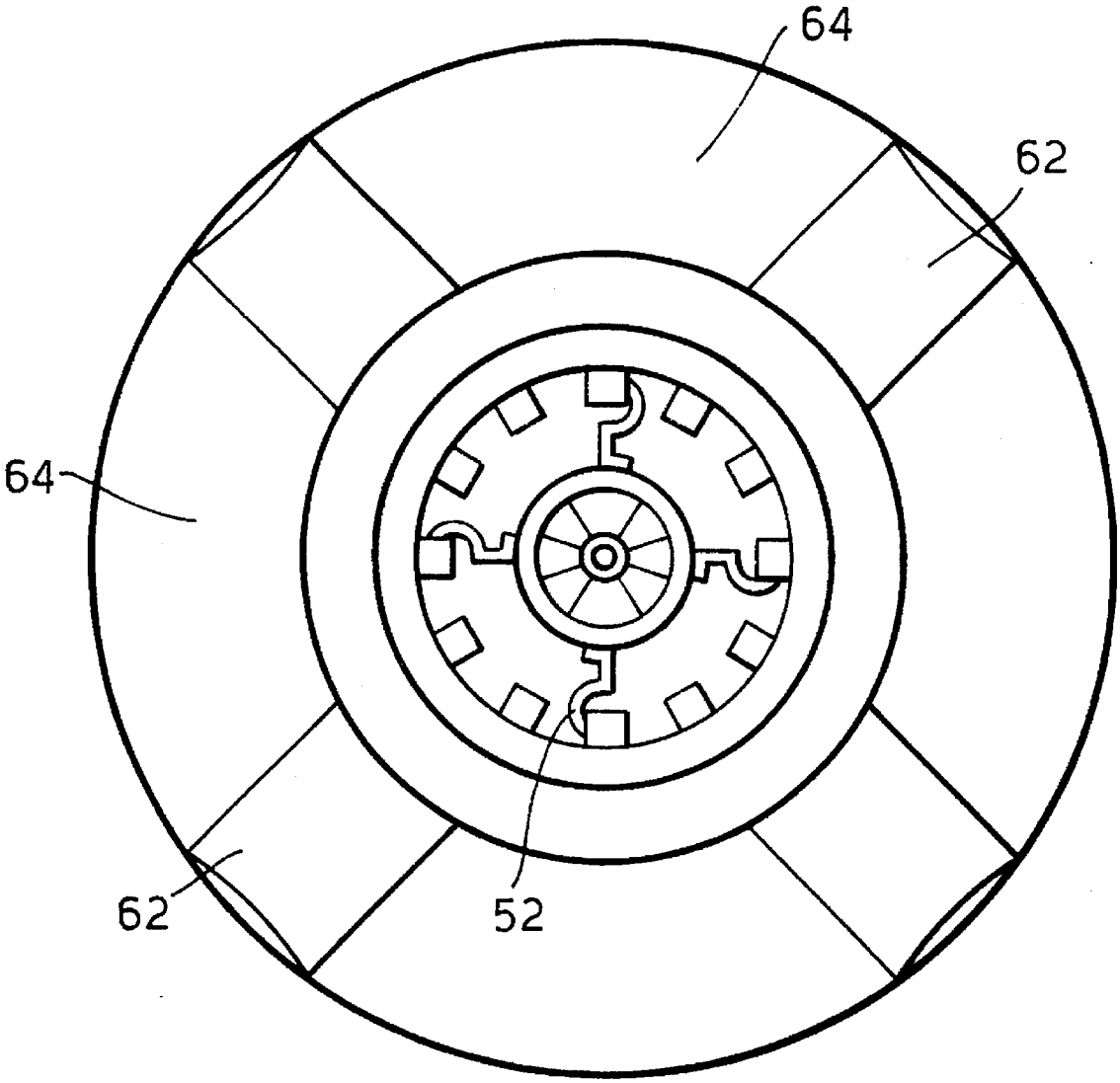
FIG. 2 is a view in the direction or arrow B in FIG. 1.

Referring to FIG. 1 a burner 10 is mounted in the wall 12 of a furnace. The burner 10 may be one of several mounted in the wall 12 of the furnace. Each burner 10 injects ignited fuel into the furnace.

The burner extends along a central axis A and comprises coaxial tubes 22, 24, 26 and 28 which define a series of concentric passages 30, 32, 34 and 36.

Located in the central passage 30 is a burner gun 38 which injects ignited fuel into the furnace. Combustion air is supplied to the burner gun 38 through a duct 40 connected to a windbox 42 or alternatively a fan 44.

A primary flow of combustion air is supplied to the annular passage 32. Fuel is suspended in the primary flow of combustion air which passes through the annular passage 32 as a spiralling stream. The tube 24 defining the passage 32 has a relatively large diameter inlet section 24A and a tapering intermediate section 24B which connects with a smaller diameter outlet portion 24C. A duct 46 joins the inlet section 24A and introduces the flow of primary combustion air into the passage 32 in an offset manner which causes the flow to swirl as it passes along the tube 24.

A wear resistant liner 48 is fitted into the inlet and intermediate sections, 24A and 24B respectively, of the tube 24. The liner 48 has integral ribs 50 extending axially of the passage 32. The fuel suspended in the primary flow of combustion air are forced radially outward as the flow spirals. The ribs 50 promote remixing of the fuel in the primary flow of air.

A series of elements 52 are mounted at equiangular spacings about the central axis A in the portion 24C of the tube. The elements 52 are blade like members which have curved cross-sections and which extend parallel to the central axis A of the annular passage 32. Fuel suspended in the primary combustion air flow impinges upon the curved faces of the elements 52. By interrupting the swirl of the fuel the elements 52 produce a series of regions with a high fuel-air ratio downstream of the elements 52.

Flow disturbing members 54 are located at the outlet end of the passage 32 downstream from the elements 52. The members 54 are wedges with bluff downstream edges and are located in the wake of the flow from the elements 52.

A secondary flow of combustion air is supplied to the annular passages 34 from the windbox 42. The amount of combustion air supplied to the annular passage 34 is controlled by a sliding annular damper 56. A set of blades 58 in the annular passage 34 swirl the combustion air before it passes to the outlet of the annular passage 34 which is divergent. The blades 58 can be moved axially to vary the degree of swirl in the air passing to the divergent outlet of the passage 34.

A tertiary flow of combustion air is also supplied by the windbox 42 to the annular passage 36. The annular passage 36 has a convergent inlet in which are provided guide vanes 60. The outlet of the annular passage 36 diverges and is partially blocked by wedge shaped plates 62. The wedge shaped plates 62 pass across the outlet of the annular passage 36 to obstruct a proportion of the tertiary flow of air. In a preferred embodiment of the present invention, in which coal is burnt, the wedge shaped plates 62 obstruct of the order of 15% of the tertiary flow of air.

In operation fuel is sprayed from the end of the burner gun 38 and when ignited combines with air from the central passage 30 to produce a flame for light up purposes. This flame serves to warm up the furnace and to ignite the flow of fuel and primary air from the passage 32 to produce a flame which attaches to the wedges 54. The flow of secondary combustion air through the passage 34 provides an additional source of oxygen to support the flame and prevent ash deposition. The tertiary flow of combustion air through the passage 36 provides oxygen for combustion later in the flame.

The tertiary combustion air flow is directed in a radially outward direction by the divergent outlets of the passage 36. As the outlet of the passage 36 is blocked by the wedge shaped plates 62 the tertiary flow discharges into the furnace through four apertures 64. Spaces are created in the tertiary combustion air flow as it discharges into the furnace.

Figure 3:
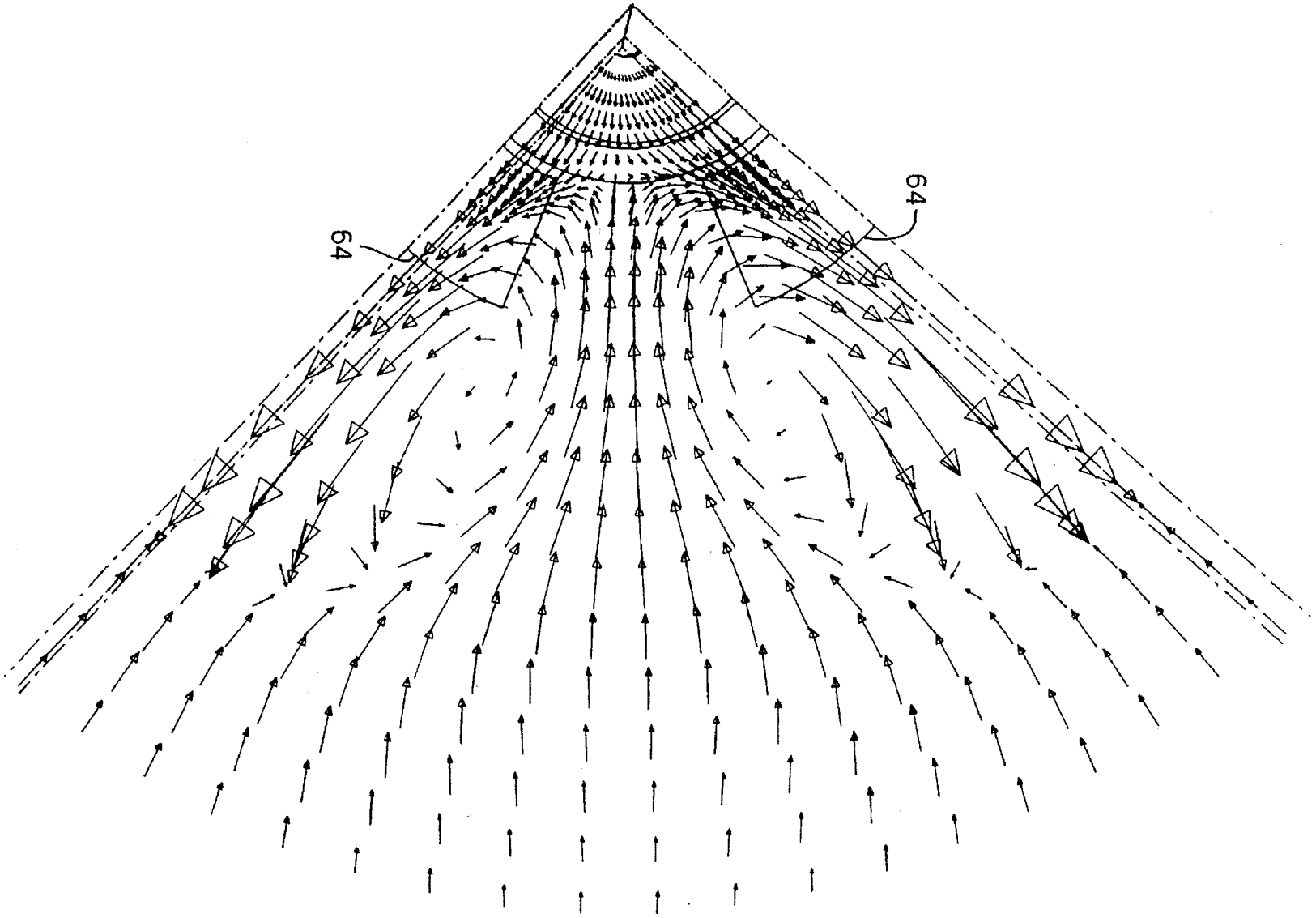
FIG. 3 is a computer flow diagram showing the flow patterns emitted from a burner in accordance with the present invention.

The spaces created in the air flow downstream of the wedge shaped plates 62 become filled by an inward flow of hot inert furnace gas which penetrates between the secondary and tertiary air flows. FIG. 3 is a computer flow diagram of the gases in the furnace and shows the circulatory flow downstream of the apertures 64. By this means mixing of the tertiary air and the primary fuel/air mixture is delayed and the concentration of the air is reduced, which results in a considerable reduction in the nitrogen oxides produced.

It will be appreciated by one skilled in the art that a burner in accordance with the present invention is suitable for use with solid, liquid or gaseous fuels.

I claim:

1. A burner for the combustion of fuel which in operation is mounted in the wall of a furnace and has a discharge plane adjacent the furnace wall comprising:

an at least one passage through which in operation a mixed flow of fuel and air passes for primary combustion at an outlet from said passage; and an at least one further annular passage concentric with and radially outward of the first passage through which a supplementary flow of air passes for discharge at an outlet for combustion with the products of said primary combustion, the at least one further annular passage diverging at its outlet to discharge the supplementary flow of air at an angle to the mixed flow of fuel and air, the outlet from the at least one further passage being provided with a plurality of members which pass across the outlet of said at least one further annular passage at the discharge plane of the burner to obstruct a portion of said at least one further annular passage, adjacent obstruction members defining a plurality of discrete apertures in the outlet of the at least one further passage through which the supplementary flow of air discharges, the apertures and orientation of the members being arranged whereby a pressure gradient is provided downstream of the obstruction members causing furnace gasses radially outward of the at least one further passage to flow radially inward and interpose between the mixed flow of air and fuel from the first passage and the supplementary air flow from the further passage, delaying mixing of the flows of the mixed flow of fuel and air and the supplementary flow of air downstream of the obstruction members and reducing the oxygen content of the supplementary air, thereby reducing the nitrogen oxides produced; the inlet to the at least one further passage being convergent and having guide vanes located therein.

2. A burner as claimed in claim 1 in which the obstructing members are wedge shaped.

3. A burner as claimed in claim 1 in which there are two further annular passages, a radially inner and a radially outer annular passage, both of which are concentric with the at least one first passage and which provide supplementary air flows for combustion with the products of said primary combustion.

4. A burner as claimed in claim 3 in which the amount of air passing through the inlet to the inner annular passage is controlled by a sliding damper.

5. A burner as claimed in claim 3 in which blades are provided in the radially inner annular passage which swirl the supplementary flow of air passing therethrough.

6. A burner as claimed in claim 5 in which the blades are moveable in an axial direction to vary the degree of swirl in the supplementary air passing therethrough.

7. A burner as claimed in claim 1 in which the at least one first passage is provided with elements which produce fuel rich areas in the air and fuel mixture passing therethrough and with flow disturbing members which modify the flow pattern of the air and fuel mixture at the outlet of the at least one first passage.

8. A burner as claimed in claim 7 in which the flow disturbing members are located in the wake of the flow from the elements.

9. A burner as claimed in claim 1 for the combustion of coal in which the obstructing members obstruct of the order of 15% of the supplementary flow of air.

* * * * *